US006374619B1

(12) United States Patent
Bessendorf

(10) Patent No.: US 6,374,619 B1
(45) Date of Patent: Apr. 23, 2002

(54) ADIABATIC MICRO-CRYOSTAT SYSTEM AND METHOD OF MAKING SAME

(75) Inventor: Simon Bessendorf, Brighton, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/442,928

(22) Filed: Nov. 18, 1999

(51) Int. Cl.[7] ..... F25B 19/02
(52) U.S. Cl. ..... 62/51.2; 62/51.1
(58) Field of Search ..... 62/51.2, 51.1

(56) References Cited

U.S. PATENT DOCUMENTS

| | | | | |
|---|---|---|---|---|
| 3,613,689 A | | 10/1971 | Crump et al. | 128/303.1 |
| 4,028,907 A | * | 6/1977 | Herrington et al. | 62/51.2 |
| 4,178,775 A | | 12/1979 | Smetana | 62/514 |
| 4,600,802 A | | 7/1986 | Ihas et al. | 174/15 CA |
| 4,647,778 A | | 3/1987 | Kline et al. | 250/352 |
| 4,791,298 A | | 12/1988 | Dunn et al. | 250/352 |
| 4,838,041 A | * | 6/1989 | Bellows et al. | 62/51.2 |
| 5,003,783 A | * | 4/1991 | Reale | 62/51.2 |
| 5,127,604 A | | 7/1992 | Klaus, Jr. et al. | 244/3.16 |
| 5,135,311 A | | 8/1992 | Alpert | 374/31 |
| 5,179,283 A | | 1/1993 | Cockrum et al. | 250/352 |
| 5,224,943 A | | 7/1993 | Goddard | 606/20 |
| 5,247,184 A | | 9/1993 | Kimball | 250/561 |
| 5,349,291 A | | 9/1994 | Kotani et al. | 324/248 |
| 5,382,797 A | | 1/1995 | Kunimoto et al. | 250/352 |
| 5,548,963 A | | 8/1996 | Skertic | 62/51.2 |
| 5,564,278 A | | 10/1996 | Gallivan | 62/51.2 |
| 5,913,889 A | | 6/1999 | Buelow et al. | 62/51.2 |
| 5,918,471 A | | 7/1999 | Mangano et al. | 62/51.2 |
| 5,932,940 A | | 8/1999 | Epstein et al. | 310/40 MM |
| 5,974,808 A | * | 11/1999 | Mangano et al. | 62/51.2 |

OTHER PUBLICATIONS

Tipler, Paul A., Physics, 1976, pp. 414–516.
Van Nostrand's Scientific Encyclopedia, 1983, pp. 38–39.
Perry, Robert H., Green, Don W., and Maloney, James O., Perry's Chemical engineers' handbook, 1984, 1973, 1963, pp. 5–28 –5–32.

* cited by examiner

*Primary Examiner*—Ronald Capossela
(74) *Attorney, Agent, or Firm*—Daly, Crowley & Mofford, LLP

(57) ABSTRACT

A cooling apparatus is described which includes a throttling valve and an adiabatic chamber having an input and an output, the output connected to an input of the cryostat. With such an arrangement, an improved cooling apparatus is provided with improved efficiency over known Joule-Thompson cooling apparatus.

14 Claims, 5 Drawing Sheets

ADIABATIC MICRO-CRYOSTAT SYSTEM AND METHOD OF MAKING SAME

STATEMENTS REGARDING FEDERALLY SPONSORED RESEARCH

Not applicable.

CROSS-REFERENCE TO RELATED APPLICATIONS

Not applicable.

FIELD OF THE INVENTION

This invention relates generally to mini-cryo coolers and more particularly to an improved adiabatic micro-cryostat system for use in an infrared seeker in a missile.

BACKGROUND OF THE INVENTION

In missile applications, it is often desirable to use an infrared seeker with infrared detectors to guide weapons to a target, particularly ground-to-air and air-to-air missiles. Infrared-sensitive devices, including infrared detectors, are preferably operated at temperatures as low as 80° Kelvin and lower. At such low temperatures, infrared detectors operate most effectively and have increased sensitivity with increased signal-to-noise ratio. Because infrared detectors are typically installed on aircraft, missiles, and other mobile devices and because the detector itself is often gimbal-mounted for tracking objects, the cooling apparatus must not only provide low temperatures but must be relatively small in mass and size and must be able to operate in varied attitudes. A cryostat, which operates as an open cycle cryo-cooler, is an apparatus which provides a localized low-temperature environment in which operations or measurements may be carried out under controlled temperature conditions. Cryostats are used to provide cooling of infrared detectors in guided missiles, for example, where detectors and associated electronic components are often crowded into a small containment package. Cryostats are also used in superconductor systems where controlled very low temperatures are required for superconductive activity and in medical cryo instrumentation.

It has been found that a cryostat based on the Joule-Thomson effect can often meet these requirements. Although in some modem applications, where large imaging focal plane arrays are involved which require significant cooling rates, even a large Joule-Thomson cryostat cannot meet the requirements. A Joule-Thomson cryostat is a cooling device that uses a valve (known in the art as a "Joule-Thomson valve") through which a high pressure gas is allowed to expand via an irreversible throttling process, resulting in lowering of its temperature. The simplest form of a conventional Joule-Thomson cryostat typically has a fixed-size orifice in the heat exchanger at the cold end of the cryostat such that cooling by the cryostat was unregulated. The input pressure and internal gas flow dynamics established the flow parameters of the coolant through the cryostat. Alternatively, some cryostats have gas throttling valves which provide the ability to start cool-down with the maximum orifice size, thereby providing high rate gas flow and refrigeration for rapid cool-down. After cool-down is achieved, the orifice size is reduced by the valve for minimal gas flow rate and sustained cooling for the thermal load. In a Joule-Thomson cryostat a flow of high-pressure coolant gas, such as nitrogen or argon at, for example, 4000–6000 pounds per square inch, is throttled. The cooling upon gas expansion converts the coolant to a liquid state. The low temperature of the coolant is then used to cool the infrared detector and the expansion-cooled outgoing coolant is also used to cool the incoming coolant. Another method of attempting to reduce the cool down time is using a dual gas system where a first gas, such as argon is used as the initial gas to reduce the cooling time and then the system switches to a second gas such as nitrogen to sustain the cooling effect at a lower temperature.

System parameters including cool-down time, the amount of cryogen, cryogen storage pressure, pressure gradient through the system, engineering complexity of dual gas systems and physical dimensions of the open and closed cryo-system must be traded off to provide a suitable cryo-cooler design. In missile applications, it is desirable to minimize the cool-down time such that the infrared detector can begin to operate more quickly after the launch. Furthermore, it is desirable to increase the efficiency of the stored bottle gas to provide a longer time of cooling of the infrared detector. Still furthermore, it is desirable to provide alternative cooling systems for millimeter wave low noise amplifiers, cryo-cooled electronics, high temperature superconductor systems and medical cryo instrumentation at efficiencies close to the ones afforded by industrial liquid cryo gas producers.

SUMMARY OF THE INVENTION

In accordance with the present invention, a cooling apparatus includes a cryostat operating on a Joule-Thomson effect and an adiabatic chamber having an input and an output, the output connected to an input of the cryostat. With such an arrangement, an improved cooling apparatus is provided with improved efficiency over known Joule-Thompson cooling apparatus.

In accordance with another feature of the present invention the adiabatic chamber includes a microturbine. With such an arrangement, the size and volume of the cooling apparatus can be reduced.

In accordance with still another feature of the present invention, the microturbine includes a microgenerator to take out the mechanical energy from the gas used in the cooling apparatus. With such an arrangement, mechanical energy of the gas can be taken out of the cooling system to reduce the cool down time of the cooling apparatus.

In accordance with a further aspect of the present invention the adiabatic chamber includes a piezo-electric material, or alternatively, a MEM (micro elecro-mechanical) fabricated device such as a silicon forest or fabricated deformation surface with a built-in voltage generator to take out energy from the gas used in the cooling apparatus. With such an arrangement, the method of removal of the mechanical energy from the immediate vicinity of the cooling volume facilitates the reduction of the cool down time of the subject thermal load.

BRIEF DESCRIPTION OF THE DRAWINGS

The foregoing features of this invention as well as the invention itself, may be more fully understood from the following description of the drawings in which.

DETAILED DESCRIPTION OF THE INVENTION

Before providing a detailed description of the invention, it may be helpful to review the state of the art of cryostats. It has been observed by the inventor, although a Joule-Thompson cryostat provides cooling to an infrared detector, turbulence and other irreversible phenomena at the mouth of a nozzle, as the gas passes through the orifice, causes heat generation which although eventually offsetted by the adiabatic cooling process, reduces the net cooldown effect and either slows down the cool-down time of the infrared detector or makes it impossible to reach the required cryogenic temperature all together. It is then clear that it is desirable to remove any mechanical energy of the gas prior to it reaching the nozzle to decrease the cool-down time. One way to take out energy is to use an adiabatic chamber where gas passing through the chamber experiences an adiabatic cooling effect and by providing the adiabatic chamber by using, for example, a microturbine or a piezoelectric device, mechanical energy of the gas as the gas cools can be removed from the gas to an electric load located outside of the cryo cooler.

It was also observed that with a lower pressure of the gas after the adiabatic chamber, the expansion at the valve after the adiabatic chamber has again a lot more adiabatic character than J-T character. This is due to the lower pressure of the gas after the adiabatic chamber than the gas straight out of the gas bottle. Thus even with the lower pressure immediately prior to the orifice, a significant greater temperature drop is experienced than experienced in the J-T case.

Conservative estimate of improvement in the efficiency of the proposed device is a factor of ten. It follows from observation that the theoretical efficiency of the J-T effect is close to seven percent of the Carno cycle at 77 degrees Kelvin, while the theoretical efficiency for the adiabatic expansion is about eighty percent of the Carno cycle at 77 degrees Kelvin. Since currently state of the art microturbines are rated at about fifty percent mechanical efficiency, it is expected that the adiabatic cryo cooler with microturbines could reach about a factor of four to five practical improvement in efficiency over the J-T cryo cooler design. The implementations which incorporate either piezo devices or MEMs would allow operation closer to the theoretical efficiency.

Figure 1:
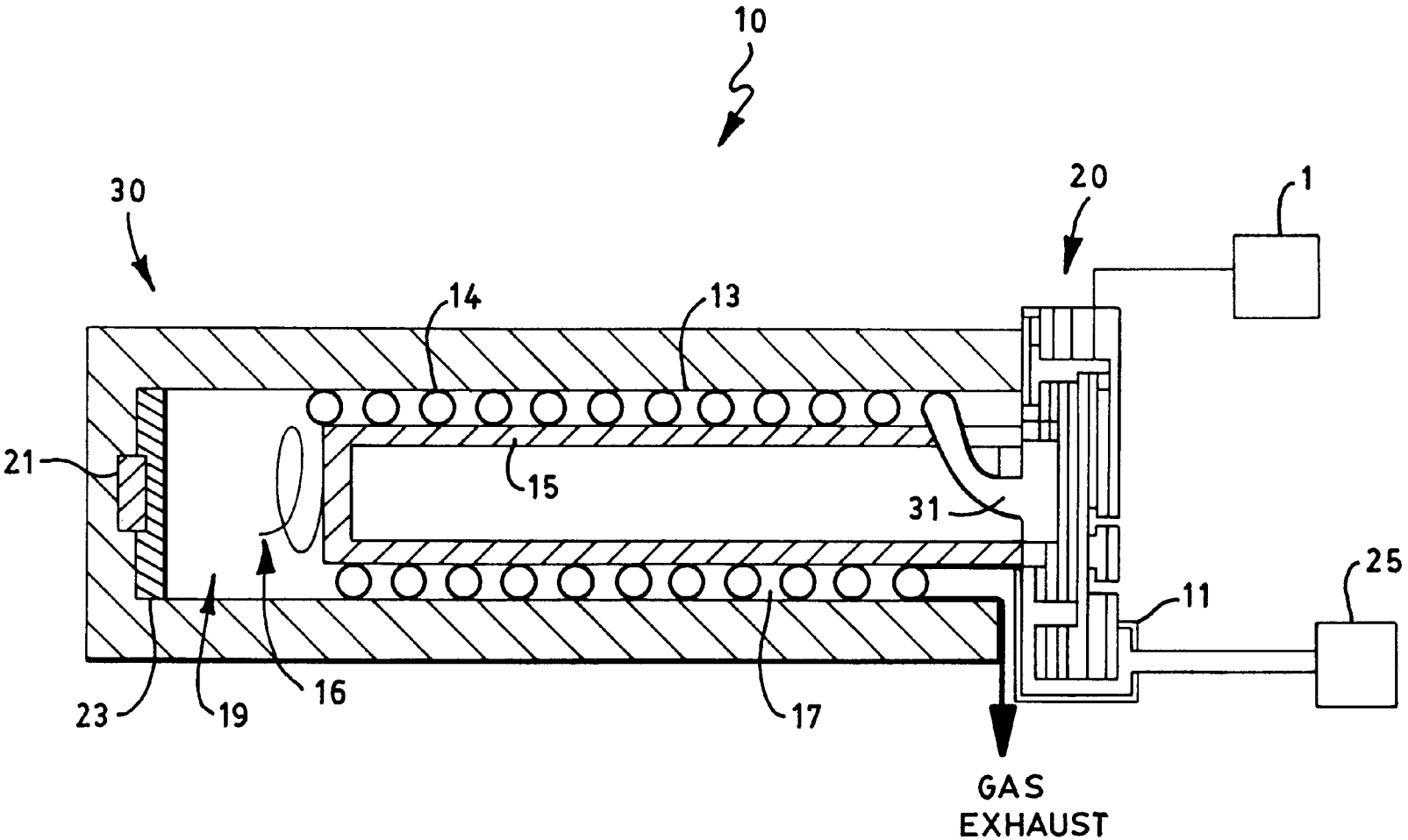
FIG. 1 is a partially broken-away perspective view of a preferred embodiment of an infrared detector and cooling apparatus of the present invention.

Referring now to FIG. 1, a sectional side view of a portion of a cryostat 10 is shown. A coolant, such as high pressure argon or nitrogen gas, is introduced through a gas inlet fitting 11 into a microturbine 20. After the microturbine 20, the expanded and cooled gas is connected to a recuperative finned tube heat exchanger 13 that encompasses a support mandrel 15. The heat exchanger 13 basically comprises counterflow finned metal tubing 14, wrapped around the mandrel 15, that allows the high pressure gas to cool significantly as it moves toward the cold end of the cryostat 10. The heat exchanger tubing 14 terminates in an orifice 16 at the end of the mandrel 15, commonly referred to as the cold end of the cryostat 10. The orifice 16 acts as a gas throttling and expansion valve. As the gas passes through the orifice 16 and enters the surrounding gas plenum chamber 19, it expands to a low pressure gas and creates a liquid form. The evaporated liquid and low pressure gas are used to cool a thermal load 21 (typically an infrared detector in the present application which is in thermal contact with a cold plate 23. The cooling of the load 21 is accomplished by a liquid coolant precipitation on and evaporation from plate 23.

The cooling rate is proportional to the mass flow rate of gas through the cryostat 10. A thermostatic element within the mandrel 15 provides self-regulation of gas flow based upon the temperature in and around the gas plenum chamber 19. For operation of the cryostat 10, a high-pressure gas stored in a bottle 25 is fed into the gas inlet 11. The gas must be of a type which has a positive Joule-Thomson cooling effect at temperatures below the temperature of the gas at the output of the microturbine 20, for example, nitrogen or argon gas. Typically, pressures are in the range of 4000 to 6000 pounds per square inch. The high-pressure gas enters the microturbine 20 causing the turbine to spin which in turn will take out mechanical energy from the cooling system as described further hereinafter. The gas typically will have a change of pressure of four to one and a drop in temperature of 90 degrees Kelvin between the input of the microturbine 20 and the output of the microturbine 20. The gas exits the microturbine 20 and spirals through the input tubing 14 and is throttled by the throttling device 16 as it enters the expansion chamber 19. The parameters of the system are chosen such the throttling will provide additional several degrees of cooling and bring about gas liquefaction. The liquefied gas then cools the heat sink 23. In this manner, temperatures in the range of 60° to 80° Kelvin can be maintained adjacent to the heat sink 23 thus cooling the load 21. Upon exit from the expansion chamber 19 into the exhaust channels 17, the gas is in a heat exchange relationship with the input tubing 14 so that the exhaust gas regeneratively cools the incoming gas, the latter providing a Joule-Thompson cooling element 30. By the term "gas" as used herein and in the appended claims, is meant any fluid material which has a positive Joule-Thomson cooling effect, such as nitrogen or argon. With such an arrangement, the cryostat 10 provides significant improvements in the cryosystem performance.

The Joule-Thomson cooling element 30 may be of any know form appropriate to the detector design. The bottle 25 of pressurized gas is connected to the input 11 via an electrically-initiated gas-flow valve (not shown) (commonly termed a pyrotechnic gas motor).

In this way the detector element or load 21 is rapidly cooled to its operating temperature, for example below 80° K.

As described previously, the expansion at the valve after the adiabatic chamber has again a lot more adiabatic character than J-T. This is due to the lower pressure of the gas after the adiabatic chamber than the gas straight out of the gas bottle. Thus even with the lower pressure immediately prior to the orifice, the temperature drop is greater than previously experienced in the J-T case.

Figure 1A:
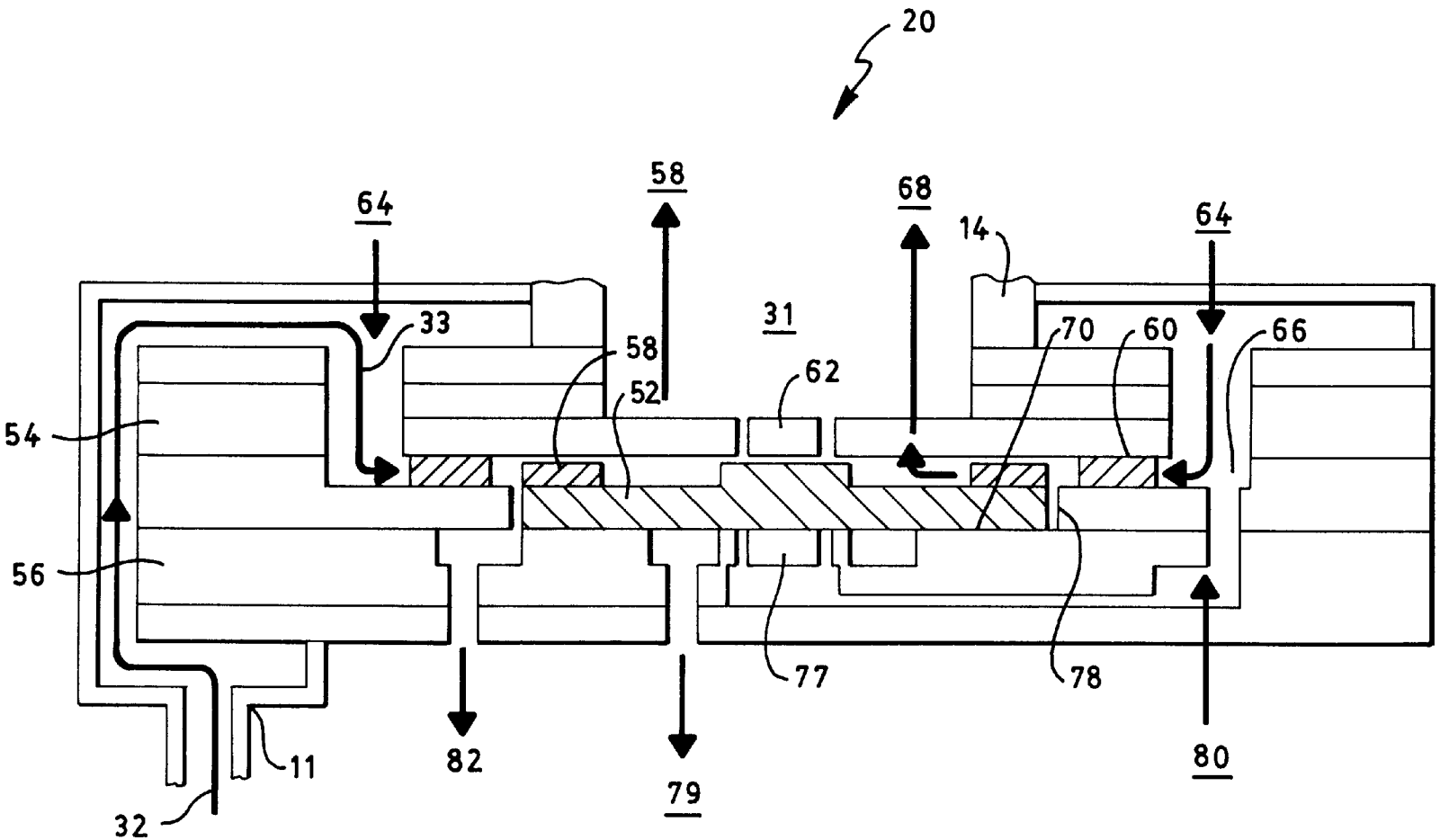
FIG. 1A is a sectional view of a microturbine used in the cooling apparatus.

Referring now to FIG. 1A, the microturbine 20 is shown to include an input 11 and an output 31 having a gas flow path 33. The microturbine 20 can be constructed in accordance with the teachings of U.S. Pat. No. 5,932,940, incorporated herein by reference, entitled "Microturbomachinery" and issued on Aug. 3, 1999. Suffice it to say here, in operation, gas 32 enters the microturbine-generator 20, hereafter also called the microturbine 20, as illustrated. The microturbine 20 includes a relatively thin, disk-shaped rotor 52 sandwiched between two end support plates, namely, a forward support plate 54 and an aft support plate 56. The forward side of the rotor disk functions as a microturbine, while the aft side functions as a microgenerator. It should be appreciated the dimensions should be scaled to accommodate the requisite space and design parameters. There is provided on the rotor blades 58 a geometry like that described in U.S. Pat. No. 5,932,940. Stationary vanes 60 are provided at the radial periphery of the turbine rotor.

In operation, compressed gas is supplied at the annular inlet 64 of the microturbine 20. Inlet gas flows aft in the turbine and turns radially inward 66 to pass through the vanes 60 and turbine rotor blades 58, after which the gas turns forward and is exhausted 68 back out of the forward end wall of the microturbine 20. As the inlet compressed gas causes the turbine rotor to turn, power is generated by way of the microgenerator on the aft side of the turbine rotor. The microgenerator is formed of the continuous turbine rotor disk aft face and an array of stator electrodes 70 arranged on the aft support plate opposite the rotor. With this configuration, the generator operates as an electric induction-type generator. Electric power produced by the microgenerator can be controlled and collected for driving a load 1 (FIG. 1) to take out energy from the cooling apparatus. As can be recognized, other generator configurations are also suitable.

Gas passing through the microturbine 20 experiences adiabatic cooling thus the gas is colder at the output of the microturbine 20 than at the input of the microturbine 20. The latter provides a temperature drop of greater than 100 degrees Kelvin. The colder gas then is fed to the Joule-Thompson cooling element 30 to further cool the infrared detector as described above. With such an arrangement, the pressure before the orifice of the Joule-Thompson cooling element 30 is lower and the temperature drop has more adiabatic characteristics which has more efficiency.

Referring again to FIG. 1, it should be appreciated that the number of microturbines 20 can be varied as needed to provide the requisite pressure ratio to obtain the above described advantages. Furthermore, the microturbine 20 can be physically separate from the Joule-Thompson cooling element 30 to reduce the size of the portion of the cooling system disposed on a gimbal in a missile or moving element in a medical instrument.

Figure 1B:
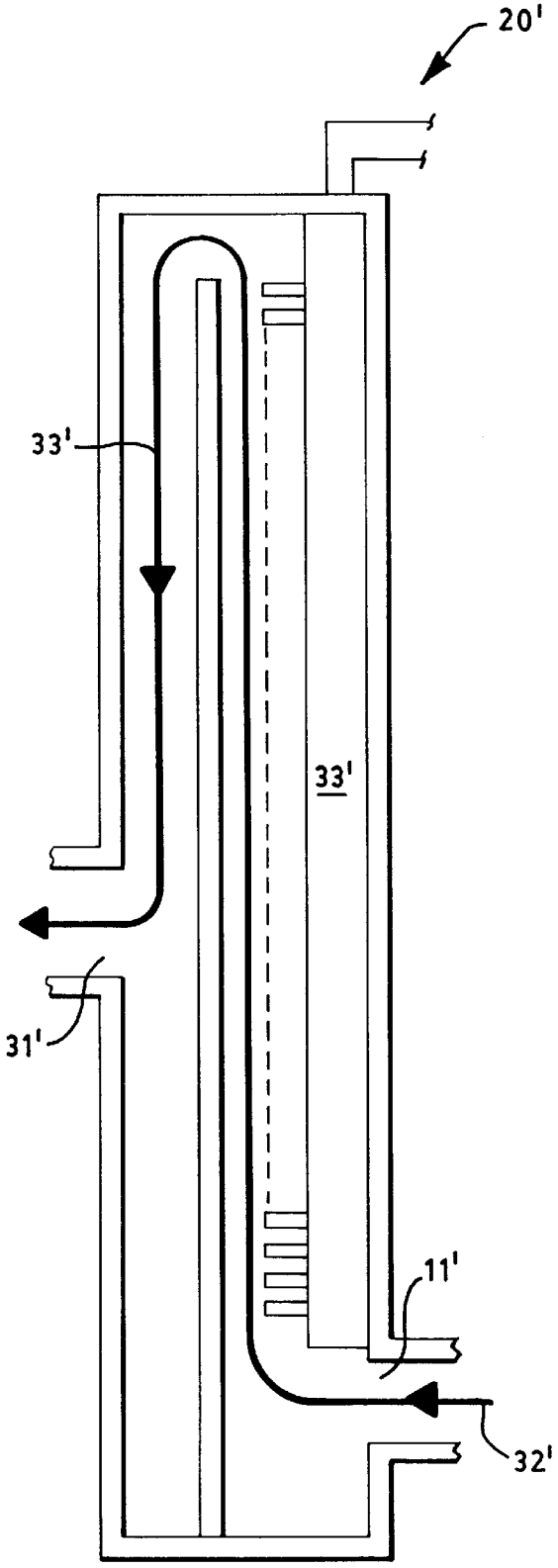
FIG. 1B is a sectional view of a piezo-electric device used in the cooling apparatus.

Referring now to FIG. 1B, an alternative embodiment is shown where a small piezo-electric device 20' is used instead of the microturbine 20. In this embodiment, the piezo-electric device 20' is shown to include an input 11' and an output 31' having a gas flow path 33'. In operation, gas 32' enters the piezo-electric device 20' as illustrated and passes over piezo-electric material 33'. Movement of the piezo-electric material produces an electric field which is fed to the load 1 taking out the energy from the cooling system as the gas passes through the piezo-electric device 20' which experiences adiabatic cooling making the gas colder at the output of the piezo-electric device 20' than at the input of the piezo-electric device 20'. In still other embodiments, a MEM (micro electro-mechanical) fabricated device such as a silicon forest or fabricated deformation surface with a built-in voltage generator to take out energy from the cooling apparatus could be used in place of the piezo-electric device 20'.

Figure 2:
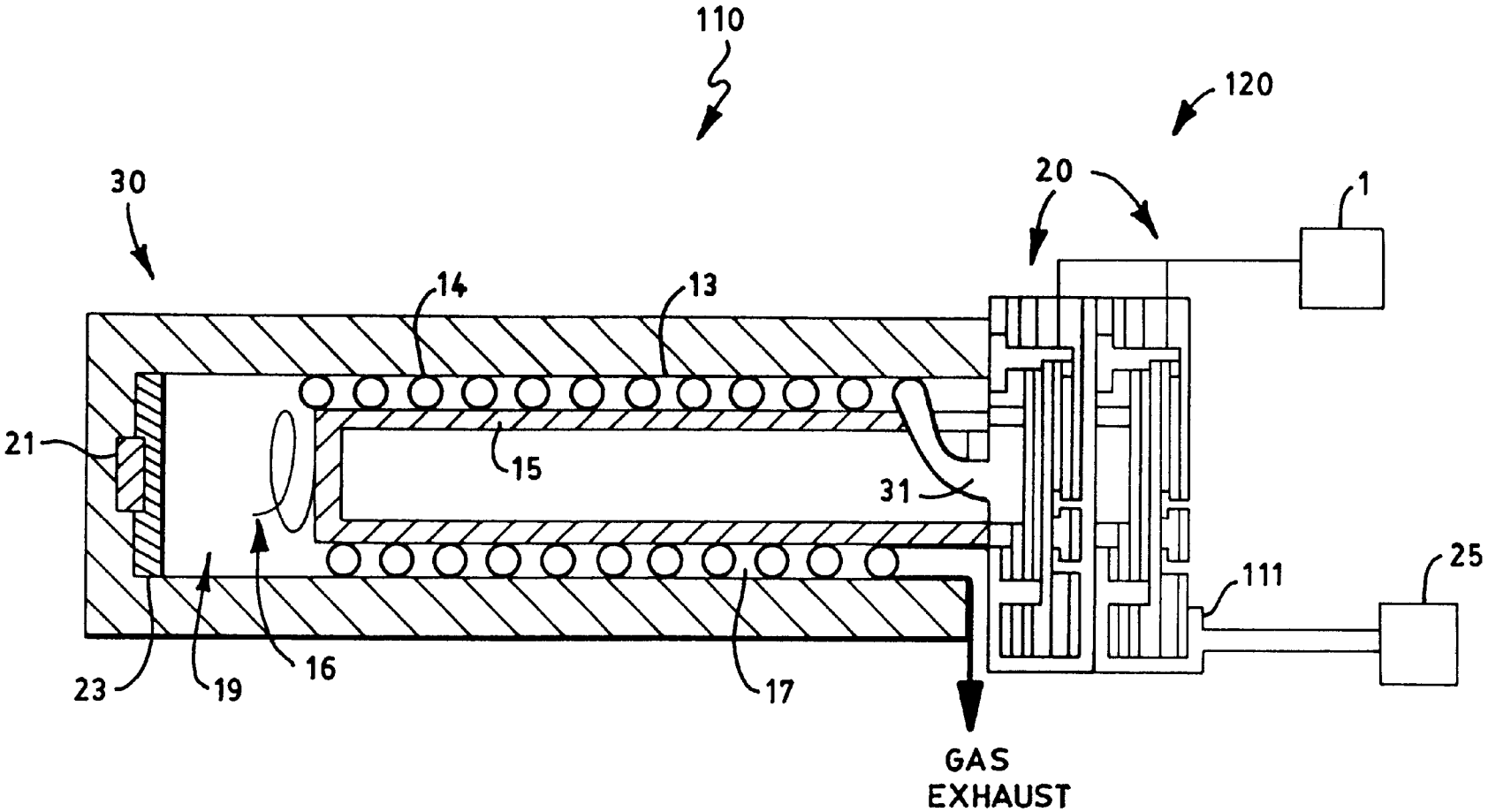
FIG. 2 is a partially broken-away perspective view of an alternative embodiment of an infrared detector and cooling apparatus of the present invention.

Referring now to FIG. 2, alternative embodiment of the present invention is shown for a cooling system cryostat 110. The cryostat 110 operates in a manner similar to that of cryostat 10 except that microturbine 20 is replaced with a pair of microturbines 120. In this embodiment, gas from a bottle 25 is fed to an input 111 of the first one of the pair of microturbines 120. The output of the first microturbine 20 is fed to the input of the second microturbine 20 and the embodiment then operates in the manner as described with FIG. 1. It should be appreciated that the small piezo-electric device 20' can also be used instead of the microturbine 20 in a similar arrangement.

In the embodiment shown, two microturbines are connected in series to provide for a greater pressure ratio. It should be appreciated that the number of microturbines can be varied as needed to provide the requisite pressure ratio. Also the microturbines could be connected in parallel or in a parallel and series arrangement.

Figure 3:
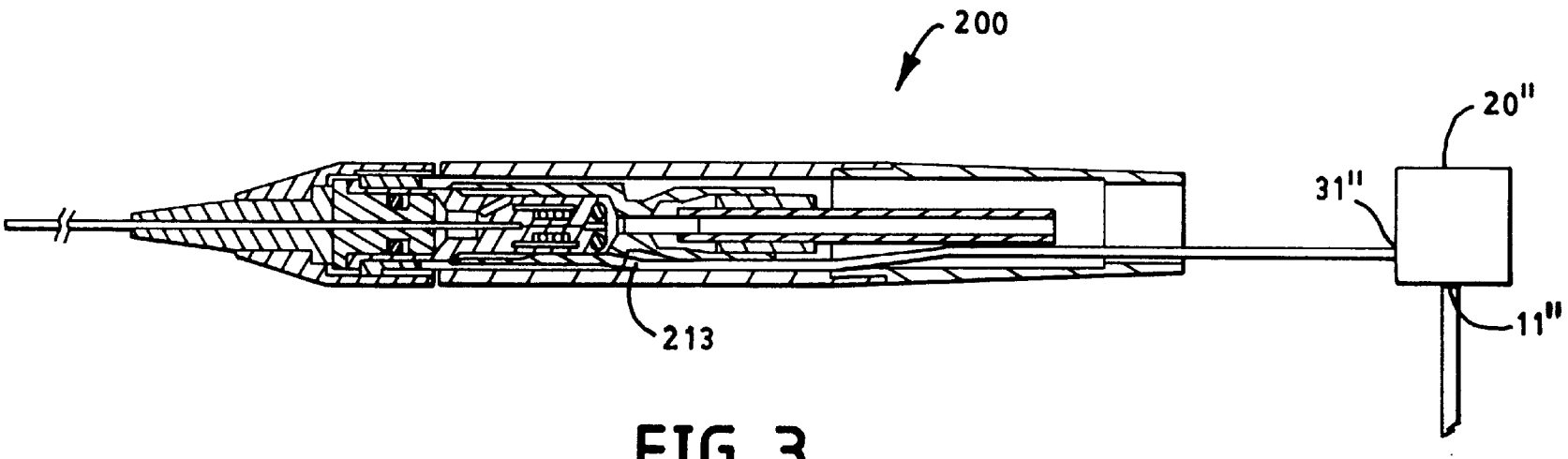
FIG. 3 is a partially broken-away perspective view of an alternative embodiment of a cryosurgical probe incorporating the cooling apparatus of the present invention.

Referring now to FIG. 3, a cryosurgical probe 200 is shown for freezing human or animal tissue in a surgical procedure. In a manner similar as described above, the cryosurgical probe 200 is cooled by expanding a gas at high pressure in a cavity at the working tip of the probe 200 whereby in accordance with the Joule-Thomson effect, the gas undergoes rapid cooling and the tip is brought quickly to its operating temperature. The cryosurgical probe 200 can be manufactured in accordance with the teachings of U.S. Pat. No. 5,224,943, entitled "Cryosurgical Apparatus", issued on Jul. 6, 1993 and incorporated herein by reference. Alternatively, the teachings of U.S. Pat. No. 3,613,689 could be used. To improve the efficiency of the cooling process, an adiabatic chamber 20" is connected to the probe 200 by passageway 213. Gas is fed to an input 11" of the adiabatic chamber 20" where gas passing through the chamber 20" experiences adiabatic cooling thus the gas is colder at the output 31" of the chamber 20 than at the input of the chamber 20". The latter provides a temperature drop of greater than 80 degrees Kelvin. It should be appreciated that the adiabatic chamber 20" can be provided either by the microturbine 20, the piezo-electric device 20' or a MEM fabricated device such as a silicon forest or fabricated deformation surface with a built-in voltage generator to take out energy from the cooling apparatus. The colder gas then is fed through passageway 213 to the cryosurgical probe 200 where a Joule-Thompson cooling element within the cryosurgical probe 200 further cools the gas as described above. With such an arrangement, the pressure before the orifice of the Joule-Thompson cooling element in the probe 200 is lower and the temperature drop has more adiabatic characteristics which has more efficiency and a more efficient cooling system is provided.

All publications and references cited herein are expressly incorporated herein by reference in their entirety.

Having described the preferred embodiments of the invention, it will now become apparent to one of ordinary skill in the art that other embodiments incorporating their concepts may be used. For example, although the invention was described in connection with an infrared detector, the principles and inventive concepts can be used with millimeter wave low noise amplifiers, cryo-cooled electronics, high temperature superconductor systems and medical cryo instrumentation. It is felt therefore that these embodiments should not be limited to disclosed embodiments but rather should be limited only by the spirit and scope of the appended claims.

What is claimed is:

1. A cryostat comprising:

a Joules-Thompson cooling element having an input;

an energy removal chamber having an input and an output, the output connected to the input of the Joules-Thompson cooling element; and a gas source having an output connected to an input of the energy removal chamber such that the energy removal chamber removes energy from the gas before the gas enters the Joules-Thompson cooling element.

2. The cryostat as recited in claim 1 wherein the energy removal chamber comprises a microturbine.

3. The cryostat as recited in claim 2 wherein the microturbine comprises a microgenerator to remove energy from the gas.

4. The cryostat as recited in claim 1 wherein the energy removal chamber comprises a piezo-electric material to remove energy from the gas.

5. A cooling apparatus comprising:

a device requiring cooling;

a source of gas;

a cryostat having an input, a throttling valve in fluid communication with the input to remove energy from the gas, and a cold plate in thermal communication with the device requiring cooling; and an energy removal chamber having an input and an output, the input connected to the source of gas and the output connected to the input of the cryostat.

6. The cooling apparatus as recited in claim 5 wherein the energy removal chamber comprises a microturbine.

7. The cooling apparatus as recited in claim 6 wherein the microturbine comprises a microgenerator to remove energy from the gas.

8. The cooling system as recited in claim 5 wherein the energy removal chamber comprises a piezo-electric material to remove energy from the gas.

9. The cooling system as recited in claim 5 wherein the device requiring cooling comprises a cryosurgical probe.

10. The cooling system as recited in claim 5 wherein the device requiring cooling comprises a heat sink and an infrared detector.

11. The cooling system as recited in claim 5 wherein the device requiring cooling comprises a heat sink and a millimeter wave low noise amplifier.

12. The cooling system as recited in claim 5 wherein the device requiring cooling comprises a cryo-cooled electronic device.

13. The cooling system as recited in claim 5 wherein the device requiring cooling comprises a high temperature superconductor.

14. A cooling apparatus comprising:

a cryostat capable of being disposed in thermal communication with a heat sink, the cryostat comprising an inlet and an exhaust outlet; and a microturbine comprising at least one micromotor-microcompressor, said microturbine having an inlet to receive a gas and an output to feed the gas to the inlet of the cryostat.

* * * * *

UNITED STATES PATENT AND TRADEMARK OFFICE

CERTIFICATE OF CORRECTION

PATENT NO. : 6,374,619 B1
DATED : April 23, 2002
INVENTOR(S) : Bessendorf

It is certified that error appears in the above-identified patent and that said Letters Patent is hereby corrected as shown below:

Column 2,
Lines 5, 45 and 54, delete “cool down” and replace with -- cool-down --.
Line 25, delete “cryo gas” and replace with -- cryo-gas --.

Column 3,
Line 17, delete “offsetted” and replace with -- offset --.
Line 18, delete “cool down” and replace with -- cool-down --.
Line 21, delete “all together” and replace with -- altogether --.
Lines 30, 47 and 49, delete “cryo cooler” and replace with -- cryo-cooler --.

Column 4,
Line 44, delete “know” and replace with -- known --.
Line 60, delete “gas flow” and replace with -- gas-flow --.

Column 5,
Line 50, delete “gas flow” and replace with -- gas-flow --.

Column 6,
Line 57, delete “cryo instrumentation” and replace with -- cryo-instrumentation --.

Signed and Sealed this

Ninth Day of July, 2002

*Attest:*

*Attesting Officer*

JAMES E. ROGAN
*Director of the United States Patent and Trademark Office*